United States Patent [19]

Anderson

[11] Patent Number: 4,522,245

[45] Date of Patent: Jun. 11, 1985

[54] HOUSING FOR A VENETIAN BLIND TILTER MECHANISM

[75] Inventor: Richard N. Anderson, Owensboro, Ky.

[73] Assignee: Hunter Douglas Inc., Totowa, N.J.

[21] Appl. No.: 492,392

[22] Filed: May 6, 1983

Related U.S. Application Data

[63] Continuation-in-part of Ser. No. 455,527, Jan. 4, 1983.

[51] Int. Cl.[3] ..... E06B 9/38

[52] U.S. Cl. ..... 160/177

[58] Field of Search ..... 160/166–178

[56] References Cited

U.S. PATENT DOCUMENTS

| | | | |
|---|---|---|---|
| 3,921,695 | 11/1975 | Debs | 160/177 |
| 4,140,169 | 2/1979 | Arena | 160/178 R |
| 4,245,687 | 1/1981 | Vecchiarelli | 160/177 |

*Primary Examiner*—Peter M. Caun

*Attorney, Agent, or Firm*—Pennie & Edmonds

[57] ABSTRACT

A housing for a venetian blind tilter mechanism. The housing comprises a single piece integrally molded body having apertures in the walls of the body serving as bearing journals for a tilter shaft having a worm gear thereon and serving as bearing journals for a worm wheel in meshing engagement with the worm gear.

12 Claims, 10 Drawing Figures

FIG.7
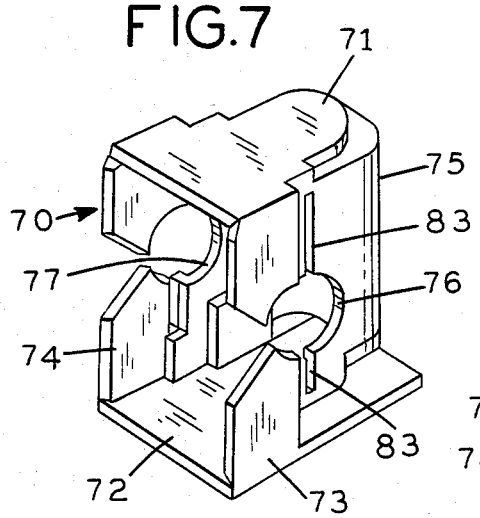
FIG.8
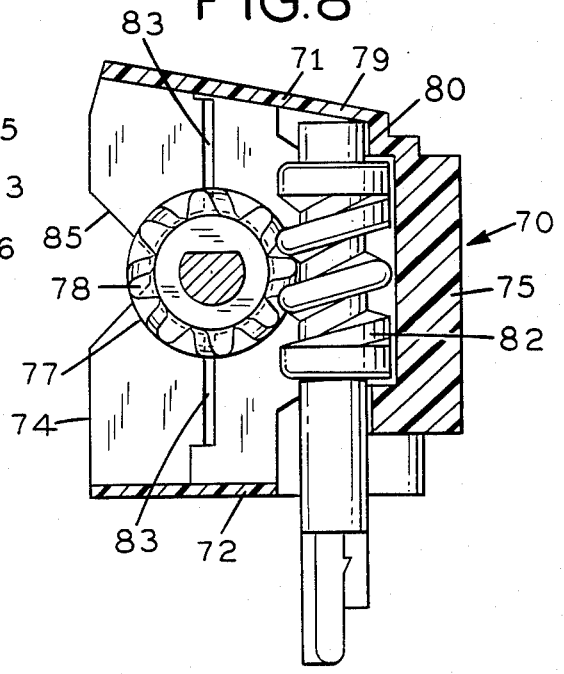
FIG.9
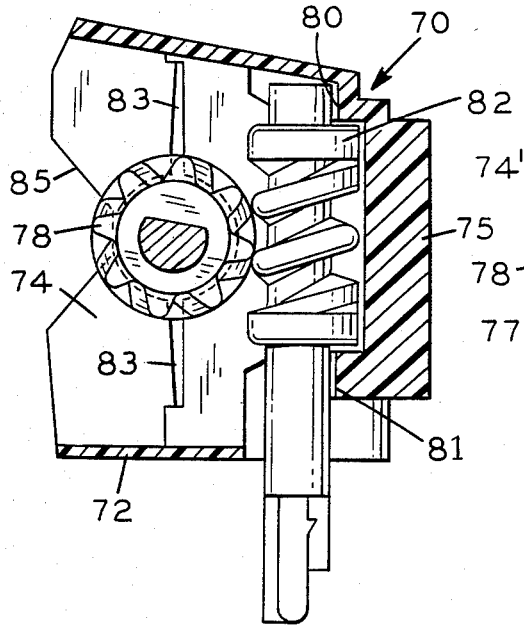
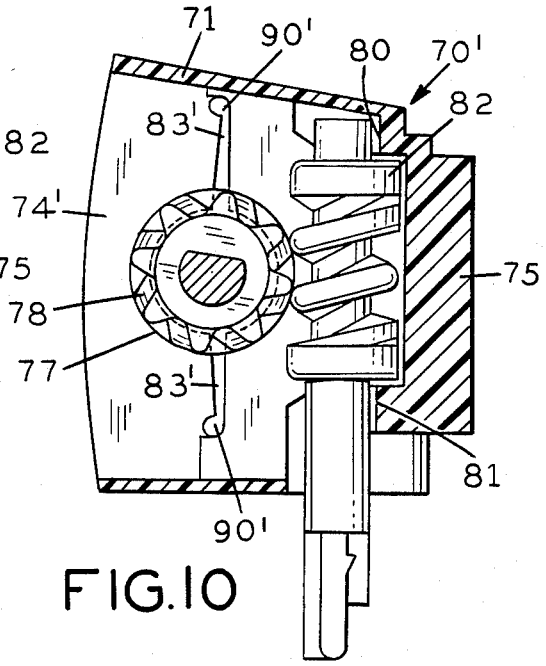
FIG.10

HOUSING FOR A VENETIAN BLIND TILTER MECHANISM

CROSS-REFERENCE TO OTHER APPLICATIONS

This application is a continuation-in-part of my copending application Ser. No. 455,527, filed Jan. 4, 1983.

FIELD OF THE INVENTION

This invention relates to a housing for a venetian blind tilter mechanism adapted to fit within a headrail through which a tilt rod extends. More particularly the invention relates to a housing which comprises a single piece integrally molded body member.

BACKGROUND OF THE INVENTION

Housings for venetian blind tilter mechanisms have been used in the past where the housings comprise two or more metal stampings held together by bendable tabs or other mechanical means. The walls of these housings have included apertures for forming journal bearings to support meshing worm gears and worm wheels contained within the housings. A problem existing with metal housings made of a number of parts has been the difficulty in maintaining and assuring precise alignment of the apertures forming the journal bearings supporting the worm wheel and worm gear. Any misalignment of the apertures results in binding of the worm gear and worm wheel increasing the force necessary to tilt the venetian blind assembly, or even in some instances, preventing such tilting. An attempt has been made to correct this alignment problem by maintaining strict manufacturing and assembly tolerances but this has necessarily resulted in increased costs.

Further cracks or spacings between the parts can allow dust or dirt to enter into the housing which can further increase the forces necessary to operate a tilting mechanism.

Stamped metal housings comprising a number of separate parts, besides having the aforementioned liabilities, also are subjected to a considerable assembly expense simply because of the operations involved in assembling and fastening separate parts together.

A further problem with conventional tilter housings having worm gears and worm wheels is that the tilter mechanism may be damaged if excessive force is applied to the mechanism in an attempt to tilt the slats of a blind beyond a limit point or if for some reason the slats become jammed and are prevented from tilting.

It is therefore an object of my invention to provide for a tilter housing which may be inexpensively manufactured while at the same time providing a structure allowing easy assembly of gearing within the housing and wherein the gearing will be in proper alignment without entailing undue quality control procedures.

It is therefore a further object of my invention to provide for a tilter housing having a slip clutch type of connection between the worm wheel and worm gear to prevent excessive forces being applied to the tilter mechanism.

GENERAL DESCRIPTION OF THE INVENTION

Broadly a preferred housing for a tilter mechanism constructed according to my invention comprises a single piece integrally molded body member. The body member has two spaced oppositedly disposed upstanding side walls with each wall having a rear portion and a front portion. Connection means in the form of a top wall joins the top edges of the side walls and in the form of a base joins the bottom edges of the side walls. An upstanding rear wall also serves as a connection means and joins the rear portions of the side walls. The front portions of the side walls define an opening in the housing.

The top wall has a portion thereof forming a top journal bearing to receive and rotatably support an end of a tilter shaft upon which a worm gear is mounted. A portion of the tilter shaft extends through an aperture in the base which serves as a bottom journal bearing to rotatably support the shaft. This aperture is aligned with respect to the top journal bearing to assure proper positioning of the shaft.

The two side walls have aligned apertures therein which serve as journal bearings to rotatably support a worm wheel, which when positioned in the apertures, will be in meshing engagement with the gear mounted on the tilter shaft.

Since the housing comprises a molded body in which the side walls, top wall, rear wall and base are all integrally joined together, it is possible to precisely maintain alignment of the various apertures forming the journal bearings to assure proper meshing engagment of the worm gear and worm wheel when assembled in the housing. This then reduces possibility of the gear and wheel binding with respect to each other.

The opening defined on one side of the housing by the front portions of the side walls, the base and top wall provides a means by which the tilter shaft and attached worm gear may be initially inserted into the housing such that the shaft extends through the aperture in the base after which the end is slipped into the top journal bearing. The worm wheel may then be inserted through the opening by forcing its sides between the side walls until it snaps into place. At this point the worm gear and worm wheel will be in proper engagement since their bearing journals will be in proper alignment.

In a preferred form of the invention, the side walls are flexible to allow easy insertion of the worm wheel therebetween and to provide a positive snap-back action to lock the wheel in place after insertion of the wheel in the apertures in the side walls.

The front portion of the side walls may in addition be flaired outwardly to further assist in guiding the worm wheel into the apertures in the side walls.

If desired, a detachable molded cover may be provided to engage with the front portions of the side walls, the base and top wall to substantially seal the opening to prevent dust or lint from entering into the housing and onto the worm gear and worm wheel.

In a further form of the invention, the side walls have slots therein to increase their flexibility. This increase in flexibility of the side walls allows the walls in which the worm wheel is mounted to deform to in turn allow movement of the worm wheel out of meshing engagement with the worm gear when forces resisting rotational movement of the wheel exceed a predetermined value such that the worm wheel acts as a slip clutch.

BRIEF DESCRIPTION OF THE DRAWINGS

FIG. 7 is a perspective view of a further embodiment of a housing constructed according to the invention;

FIG. 8 is a side sectional view of the housing of FIG. 7 showing a worm gear and worm wheel in meshing engagement;

FIG. 9 is a view similar to FIG. 8 showing the worm gear and worm wheel in slipping engagement; and FIG. 10 is a side sectional view of a still further form of a housing constructed according to the invention showing a worm wheel and worm gear in slipping engagement.

DETAILED DESCRIPTION OF THE PREFERRED EMBODIMENTS

Figure 1:
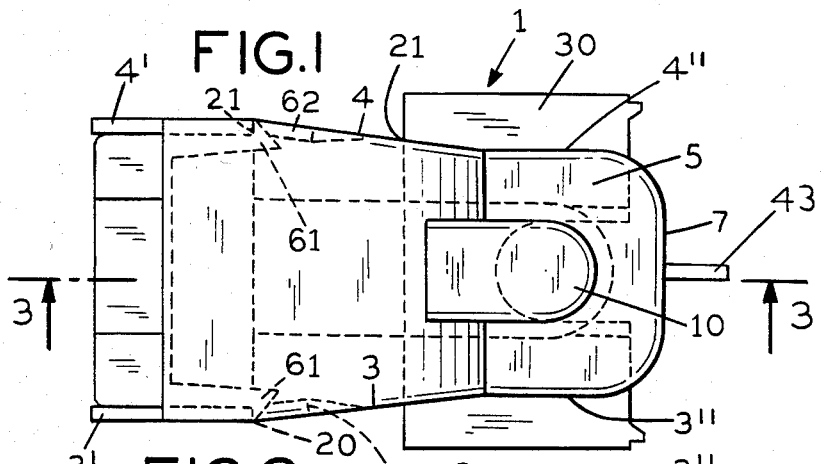
FIG. 1 is a plan view of a housing constructed according to the invention.
Figure 2:
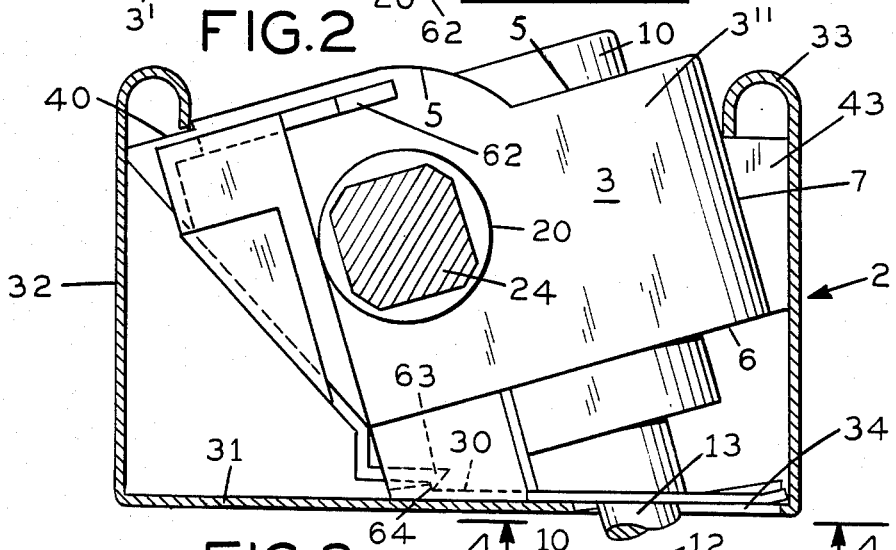
FIG. 2 is a side view of the housing of FIG. 1 as installed in a headrail.
Figure 3:
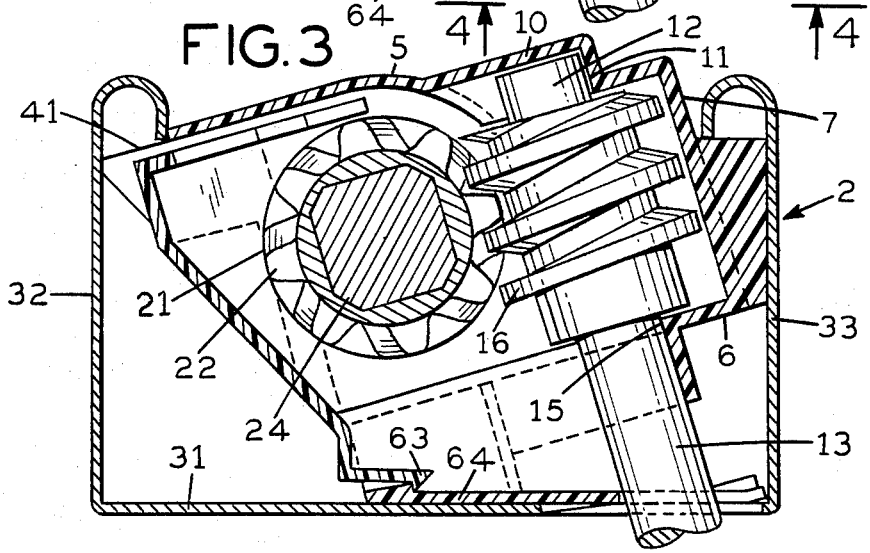
FIG. 3 is a sectional view of FIG. 1 taken along lines 3—3.

Referring to FIGS. 1–5, there is illustrated a housing 1 constructed according to the invention and, as more particularly shown in FIGS. 2 and 3, assembled within a conventional U-shaped headrail 2. The housing 1 comprises two spaced oppositely disposed upstanding side walls 3 and 4 each having a front portion 3′ and 4′ and a rear portion 3″ and 4″. A top wall 5 joins the top edges of the side walls 3 and 4 while a base 6 joins the bottom edges of the side walls. An upstanding rear wall 7 joins the rear portion 3″ and 4″ of the side walls, the base 6 and top wall 5.

As shown in FIG. 3 top wall 5 has a portion 10 which accommodates a recess 11 to form a top journal bearing therein into which an end 12 of a tilter shaft 13 may be rotatably supported. The base 6 has an aperture 15 which serves as a bottom journal bearing for the shaft 13. Aperture 15 and recess 11 are aligned with respect to each other so as to provide a proper alignment of the shaft 13 and attached worm gear 16.

The side wall 3 has an aperture 20 therein while the side wall 4 has an aperture 21 therein aligned with aperture 20. Apertures 20 and 21 are adapted to provide journal bearings for a worm wheel 22 having stub extensions 22′ on each side thereof which are rotatably supported in the apertures. The wheel 22 and extensions 22′ have a hexagonal bore therein adapted to receive a hexagonally shaped tilt rod 24 as shown in FIG. 2.

The housing may conveniently be mounted within the headrail 2 by a base extension 30 adapted to rest on the connecting portion 31 of the headrail connecting the flanges 32 and 33. The base extension 30 is inclined with respect to the tilter shaft such that the shaft 13 will in turn be inclined with respect to the headrail so that it may extend through cutout 34 at an angle to allow convenient engagement by a tilt wand, not shown.

Figure 5:
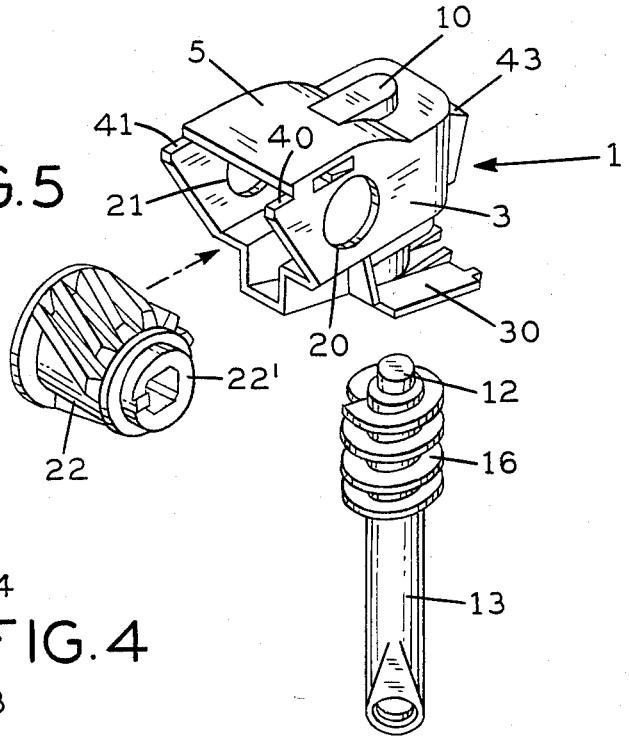
FIG. 5 is a perspective exploded view of the housing of FIG. 1 illustrating a tilter shaft and worm gear and a worm wheel prior to assembly.
Figure 4:
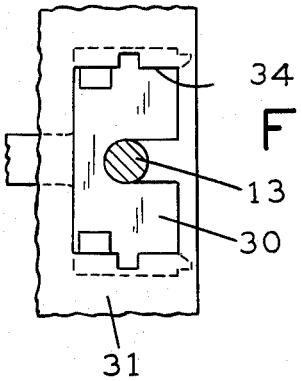
FIG. 4 is a bottom view of FIG. 2 taken along lines 4—4.
Figure 6:
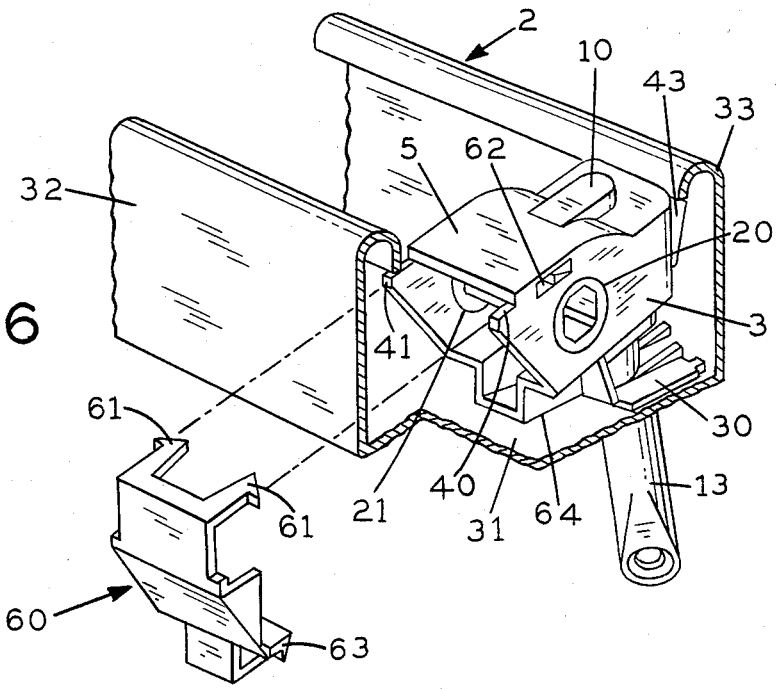
FIG. 6 is a perspective exploded view of a housing constructed according to FIG. 1 having a cover prior to assembly to the housing.

Side walls 3 and 4 have extensions 40 and 41 on the front portions of the side walls 3 and 4 as shown in FIGS. 5 and 6 adapted to engage the inturned edge of the flange 32. A shoulder portion 43 is positioned on the rear wall 7 and is adapted to engage the inturned edge of the flange 33. The base extension 30, extensions 40 and 41 and the shoulder portion 43 all act together to securely fasten the housing within the U-shaped headrail.

The housing is installed in the headrail by inserting the housing through the open top of the headrail with the housing turned 90° from the position as shown in FIG. 6 and such that the tilter shaft 13 extends through the cutout 34 when the extension 30 engages the connecting portion 31 of the headrail. The housing is then turned 90° until the extensions 40 and 41 and shoulder 43 snap into engagement with the ends of the inturned rims of the flanges 32 and 33.

The assembly of the worm gear and worm wheel is as follows. Prior to assembly of the housing in the headrail, the shaft 13 and attached worm gear 16 is inserted through the opening in the housing defined by the front portions 3′ and 4′ of the side wall, the base 6 and the top wall 5 so that the shaft 13 extends through aperture 15. The end of the shaft 13 is then slid into recess 11 such that the recess and aperture position the shaft.

The worm wheel 22 is then forced through the opening of the housing with the extensions 22′ engaging the side walls 3 and 4 until the extensions snap into the apertures 20 and 21 in the side walls at which point the wheel 22 will be in correct meshing engagement with the worm gear 16. The tilt rod 24 may then be inserted through the wheel 22.

In some instances it may be desirable to have the outer portions 3′ and 4′ of the side walls flare outwardly from the center of the housing as shown in FIG. 1. This construction assists in guiding the wheel 22 into position with the apertures 20 and 21.

The housing may, if desired, be provided with a detachable cover 60 as shown in FIG. 6 to substantially seal the opening in the housing to which reference was previously made. The cover has two bayonet-type fasteners 61 adapted to be snapped into slots 62 contained in the side walls as shown in FIG. 1 and a lip 63 adapted to engage a shoulder 64 on the base 6 as shown in FIGS. 2 and 3. The cover is applied by sliding the bayonet fasteners and lip through the opening until the fasteners 51 snap into place in the slots 62 and the lip 63 snaps over the shoulder 64.

The housing and cover are preferably made of a plastic material so as to be easily molded or cast and so that the side walls of the housing will be sufficiently flexible to receive the worm wheel which is forced into place between the side walls and so that the fasteners and lip of the cover may flex sufficiently so as to be snapped into place.

Referring to FIGS. 7–9, a further form of a tilter housing 70 is shown having a top wall 71, a bottom wall 72, side walls 73 and 74 and an upstanding rear wall 75. As in the construction shown in FIGS. 1–6, the housing 70 has aligned apertures 76 and 77 in the side walls which form journal bearings for a worm wheel 78, a portion 79 of the top wall containing a recess 80 forming a top journal bearing and an aligned aperture 81 in a part of the bottom wall 72 forming a bottom journal bearing. Both the top and bottom journal bearing rotatably support a worm gear 82 which as shown in FIG. 8 is in meshing engagement with worm wheel 78.

The side walls 73 and 74 each have slots 83 therein in the form of slits extending completely through the side walls and extending from the apertures 76 and 77. These slots allow the side walls to be deformed as shown in FIG. 9 when the resistence to turning the worm wheel 78 becomes so great as to cause the wheel to ride up upon the teeth of the worm gear 82 so as to move the wheel outwardly out of meshing engagement with the worm gear. At this point the teeth of the worm wheel will slide over the teeth of the worm gear to act as a slip clutch and prevent excessive forces being applied to the tilter mechanism.

Preferably two slots are contained in each side wall and extend radially outwardly of the aperture. While the slots are shown in the form of slits extending completely through the side walls, they could extend only partially into the side walls, the only requirement being that they impart sufficient flexibility to the side walls adjacent the apertures to allow the walls to be deformed on application of a predetermined force on the tilting mechanism comprising the worm gear and worm wheel so as to allow the wheel to move with respect to the gear.

A tapered cutout 85 may extend from the apertures 76, 77 to the front portion of the side walls to further increase flexibility of the walls and to provide a guide surface to assist in insertion of the worm wheel in the housing. This further increase in flexibility of the walls achieved by the cutouts also permits movement of the wheel away from the worm gear to provide a clutch action.

Referring to FIG. 10 wherein like parts have like numbers, a further form of housing 70' is illustrated where the side wall 74' is shown solid without any tapered cutout and having modified slots 83'. Each slot 83' has a rounded portion 90' cut in the end thereof opposite the aperture from which it extends to further increase the flexibility of the side wall allowing the outer portion to bow outwardly as shown in FIG. 10 to in turn allow the wheel 78 to move out of meshing engagement with the worm gear 82. The other opposite side wall, not shown, would have a similar construction.

As described, the top wall and base each comprise a connecting means connecting the side walls together to form a rigid unitary housing. The upstanding rear wall also comprises a connecting means to connect the side walls together to form a rigid housing. It is apparent that in those instances where a sealed enclosed housing is not required that either the top wall and base or the upstanding rear wall could be eliminated with the remaining structure providing the required connecting means connect the side walls together. In the event that either of or both the top wall and base were eliminated, the rear upstanding wall would have to be furnished with portions to include the top and bottom journal bearings for the worm gear.

I claim:

1. A housing for a venetian blind tilter mechanism comprising a single piece integrally molded body member comprising two spaced oppositely disposed upstanding side walls each having a rear portion and a front portion, and at least one connecting means joining said side walls, and said body member having a portion forming a top journal bearing to support an end of a rotatable tilter shaft carrying a worm gear, a portion forming a bottom journal bearing aligned with the top journal bearing for rotatably supporting a portion of the tilter shaft, two aligned apertures in said side walls adapted to form side journal bearings for rotatably supporting a worm wheel in meshing engagment with said worm gear, and said body member having an opening formed by said side walls through which said tilter shaft and worm gear may be inserted to position the tilter shaft in the bottom journal bearing and an end thereof in the top journal bearing and through which the worm wheel may be inserted and positioned in the apertures in the side walls whereby the worm wheel will be positioned in aligned meshing engagement with the worm gear.

2. A housing for a venetian blind tilter mechanism according to claim 1 wherein the side walls are flexible whereby they may be forced apart to receive said worm wheel and snap back after said worm wheel is positioned in the apertures in the side walls to hold the same in meshing engagement with the worm gear.

3. A housing for a venetian blind tilter mechanism according to claim 2 wherein said front portions of the side walls are flared outwardly with respect to each other whereby they may assist in guiding the worm wheel into position in the apertures of the end walls.

4. A housing for a venetian blind tilter mechanism according to claim 1 where said connecting means comprises a top wall joining top edges of said side walls and a base joining bottom edges of said side walls and where said portion forming a top journal bearing comprises a part of said top wall and said portion forming a bottom journal bearing comprises a part of said base.

5. A housing for a venetian blind tilter mechanism according to claim 1 having in addition a molded cover adapted to engage with the front portions of the side walls to substantially seal said opening.

6. A housing for a venetian blind tilter mechanism according to claim 1 wherein said connecting means comprises an upstanding rear wall joining said side walls and where said portion forming a top journal bearing is connected to said rear wall and said portion forming a bottom journal bearing is connected to said rear wall.

7. A housing for a venetian blind tilter mechanism according to claim 1 having in addition at least one slot in each side wall connecting with an aligned aperture whereby said side walls may be deformed to allow movement of said worm wheel out of meshing engagement with said worm gear to act as a slip clutch when forces resisting rotation of said worm wheel exceed a predetermined value.

8. A housing for a venetian blind tilter mechanism according to claim 7 wherein each said slot extends radially of an aligned aperture.

9. A housing for a venetian blind tilter mechanism according to claim 7 wherein said slot comprises a slit extending completely through a side wall.

10. A housing for a venetian blind tilter mechanism according to claim 7 having in addition a tapered cutout in each said side wall extending from an aligned aperture to the front portion of said side wall.

11. A housing for a venetian blind tilter mechanism according to claim 1 having in addition at least one cutout in each said side wall extending from an aligned aperture to the front portion of said side wall whereby said side walls may be deformed to allow movement of said worm wheel out of meshing engagement with said worm gear to act as a slip clutch when forces resisting rotation of said worm wheel exceed a predetermined value.

12. A housing for a venetian blind tilter mechanism comprising a single piece integrally molded body member comprising two spaced oppositely disposed upstanding side walls each having a rear portion and a front portion, a top wall joining top edges of said side walls, a base joining bottom edges of said side walls, a portion of said top wall forming a top journal bearing and a portion of said base forming a bottom journal bearing aligned with said top journal bearing to rotatably support a tilter shaft carring a worm gear, two aligned apertures in said side walls adapted to form side journal bearings for rotatably supporting a worm wheel in meshing engagement with said worm gear, and said body member having an opening formed by said side walls through which the worm wheel may be inserted and positioned in the apertures in the side walls whereby the worm wheel will be positioned in aligned meshing engagement with the worm gear.

* * * * *